United States Patent [19]

Bergmann et al.

[11] 4,352,378

[45] Oct. 5, 1982

[54] RIBBED CONSTRUCTION ASSEMBLED FROM SHEET METAL BANDS FOR IMPROVED HEAT TRANSFER

[75] Inventors: György Bergmann; Mihály Horváth; György Pálfalvi; Gábor Tomcsányi; Gyula Kovács, all of Budapest; Kárdy László, Jászberény, all of Hungary

[73] Assignee: TRANSELEKTRO Magyar Villamossagi Kulkereskedelmi Vallalat, Budapest, Hungary

[21] Appl. No.: 169,318

[22] Filed: Jul. 16, 1980

[30] Foreign Application Priority Data

Jul. 16, 1979 [HU] Hungary ..... EE 2679

[51] Int. Cl.[3] ..... F28B 3/02

[52] U.S. Cl. ..... 138/38; 366/337; 165/179

[58] Field of Search ..... 138/37, 38, 39, 42; 366/337; 165/109 T, 179

[56] References Cited

U.S. PATENT DOCUMENTS

| | | | |
|---|---|---|---|
| 2,646,972 | 7/1953 | Schmid | 138/38 X |
| 2,929,408 | 3/1960 | Weatherwax et al. | 138/38 |
| 3,783,938 | 1/1974 | Chartet | 138/38 X |
| 4,200,149 | 4/1980 | Pechner | 138/38 X |
| 4,265,275 | 5/1981 | Heller et al. | 138/38 |

FOREIGN PATENT DOCUMENTS

| | | | |
|---|---|---|---|
| 2328795 | 9/1976 | Fed. Rep. of Germany | 138/38 |

*Primary Examiner*—Stuart S. Levy
*Assistant Examiner*—Daniel P. Stodola

[57] ABSTRACT

A ribbed construction assembled from sheet metal bands for improved heat transfer, suitably built into the pipes of heat exchangers forms the arrangement of the invention. The ribbed construction assembled from toothed metal bands ensures the improved heat transfer primarily by slowing down the velocity of the medium flowing in the center of the pipe; furthermore it improves the temperature distribution of the flowing medium by means of metallic contact and mixing. Although the ribs are easily movable in the pipe, a significant portion of the tooth-ends is in loose contact with the inner pipe wall, which likewise improves the heat transfer.

11 Claims, 17 Drawing Figures

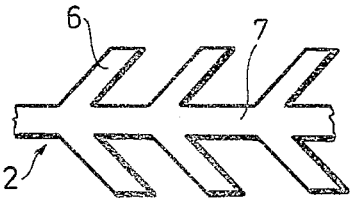
Fig. 7
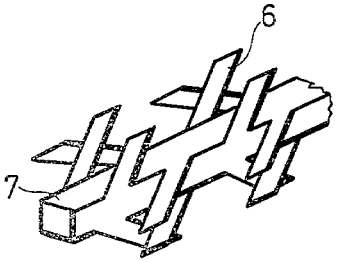
Fig. 8
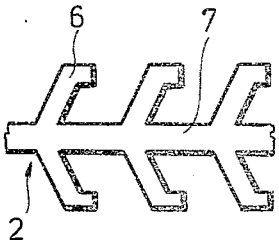
Fig. 9
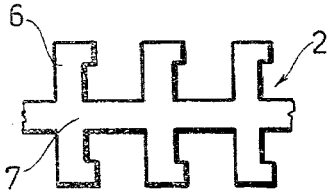
Fig. 10
Fig. 11a
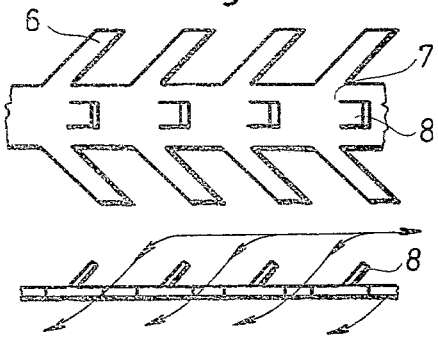
Fig 11b

RIBBED CONSTRUCTION ASSEMBLED FROM SHEET METAL BANDS FOR IMPROVED HEAT TRANSFER

BACKGROUND OF THE INVENTION

The invention relates to a ribbed construction assembled from sheet metal bands for improved heat transfer suitably built into the pipes of heat exchangers.

The ribbed construction according to the invention improves the heat transfer primarily by slowing down the velocity of the medium flowing through the central part of the pipe; furthermore it improves the temperature distribution of the medium in the cross section of the pipe by metallic conduction and mixing. Although the ribs in the pipe are easily movable, a significant portion of the tooth ends are in loose contact with the inner wall of the pipe, thereby improving the heat transfer.

It is well-known that the heat transfer between the media of high viscosity and the pipes through which the media flows is very poor due to ineffective heat conduction. This is caused by the so-called laminar flow of these media in the pipe, i.e. there is no, or hardly any, flow in the immediate vicinity of the wall, while moving away from the pipe wall towards the center of the pipe, the flow velocity increases. Since there is virtually no mixing over the cross section, the heat can only pass between the large quantity of liquid flowing in the center of the pipe cross section and the pipe wall, if it passes through the layers near the pipe wall. These layers represent genuine thermal insulation on the inner pipe wall in the case of a poor heat conducting medium, and thus they considerably inhibit the heat transfer.

In the techniques of the state of the art, in order to improve the heat transfer conditions, the internal surface of the pipe is provided with ribs, whereby the heat transfer surface is increased, these ribs extend partially into the center of the pipe cross section, there exerting a direct cooling effect.

The internal ribs fitted in the pipe are known as internal rib solutions. These may be formed from the material of the pipe itself, or welded to the inner surface of the pipe. Furthermore the internal ribs which are removable from the pipe and fixed therein only by friction, are also known, being in contact with the pipe wall, thereby ensuring metallic contact between the rib and pipe.

The first solution completely fulfills the goal of the rib's cooling effect which is excellent, since even in case of welding, the heat is transmitted to the pipe wall through metallic contact. However, the production of such ribbed pipe is fairly costly, making the cleaning of the pipe interior difficult or even impossible.

The second solution facilitates the cleaning, because the ribs are removable from the pipe, but in the interest of removability, the ribs can not have a tight fit with the inner pipe wall, thus the metallic contact between the ribs and the pipe deteriorates, especially after several insertions and removals.

SUMMARY OF INVENTION

It is a general object of this invention to provide an improved ribbed construction for heat transfer, assembled from sheet metal bands, in which the rib formation—contrary to the conventional constructions—improves the heat transfer conditions as follows: by not taking up the heat from the cross section of the liquid flow spaced from the pipe wall, and transmitting it directly to the pipe wall through metallic contact; the arrangement of the invention transforms the flow and temperature distribution conditions in the pipe in such a way, as to improve the heat transfer conditions.

The foregoing is fulfilled according to the invention with a special ribbed construction embedded in the pipe, which is assembled from sheet metal bands and wherein each band is provided with toothing.

This toothing fits into the toothed spacing of the adjacent sheet metal band. The central part of the metal bands forms a channel.

In a preferred embodiment of the ribbed construction according to the invention, the channel is in the shape of a regular polygon. The number of the metal bands is suitably three or four. Formation of the teeth may be perpendicular to or at an angle to the longitudinal axis of the pipe conduct. In certain embodiments the ends of the teeth widen out.

In further preferred embodiments baffle plates are bent out from the central part of the metal bands. The metal bands are suitably arranged in relation to each other so that at least on one metal band the baffle plates extend in the direction approaching the center-line of the construction, and at least on another metal band the baffle plates extend in the direction moving away from the center-line of the construction.

The ribbed construction can be realized by building a buffer into the pipe-end, or by determining the shape of the toothed metal band in contact with the inner pipe wall. It was found, that the ribs equalize the otherwise laminar flow, which produces a highly inhomogeneous temperature and velocity profile, because they transmit heat from the central part of the liquid flow to the vicinity of the pipe wall, while the braking effect of the large rib surface in the center of the flow prevents the intermediate masses of liquid from passing through the pipe at high velocity.

In this way the significance of the metallic contact between the rib and pipe wall diminishes with respect to the heat transfer, and the tight fitting of the ribs to the pipe wall is not necessary. The loose inner ribs are easily removable from and returnable into the pipe, thus the heat exchanger is easily cleaned. Since originally the ribs are loose, the heat transfer conditions are not altered because of the wear arising in the course of removal and insertion of the ribs during the several cleaning processes of the heat exchanger. Further advantage of this rib formation resides in that such rib formation may also be used, which after removal can be taken apart and converted to flat sheet metal bands, the cleaning of which is similarly effective and the production of which is simple at the same time.

BRIEF DESCRIPTION OF THE DRAWING

The technical solution according to the invention is described in detail by using several preferred embodiments of the invention in the enclosed drawings, in which:

FIG. 7 is a front elevational view of metal bands provided with toothing arranged at an angle;

FIG. 8 is a perspective view of the ribbed construction in accordance with the invention formed by metal bands according to FIG. 7;

FIG. 9 is a front elevational view of a metal band having angularly projecting portions with their ends widening out;

FIG. 10 is a front elevational view of a straight metal band with the end of the projecting teeth widening out;

FIG. 11*a* is a front elevational view of a metal band provided with baffle plates;

FIG. 11*b* is a side view of the band of FIG. 11*a;*

DETAILED DESCRIPTION

As demonstrated by the drawings, the ribbed construction forms a spatial construction assembled from metal bands. Teeth 6 are machined on both sides of the metal bands to an appropriate length in such a way that the spacing between the afore-mentioned teeth 6 is greater than the width of teeth 6.

Figure 1:
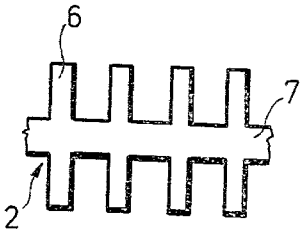
FIG. 1 is a front elevational view of a sheet metal band provided with perpendicular toothing.
Figure 2:
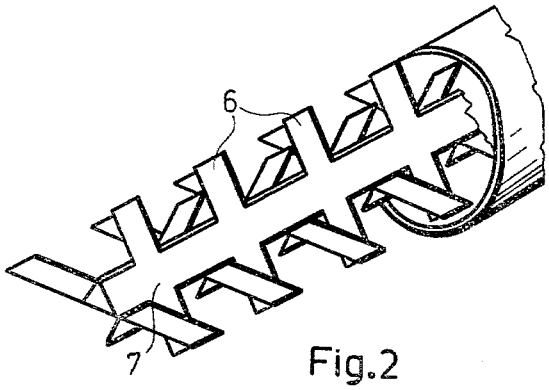
FIG. 2 is a perspective view of the ribbed construction in accordance with the invention consisting of three metal bands.
Figure 3:
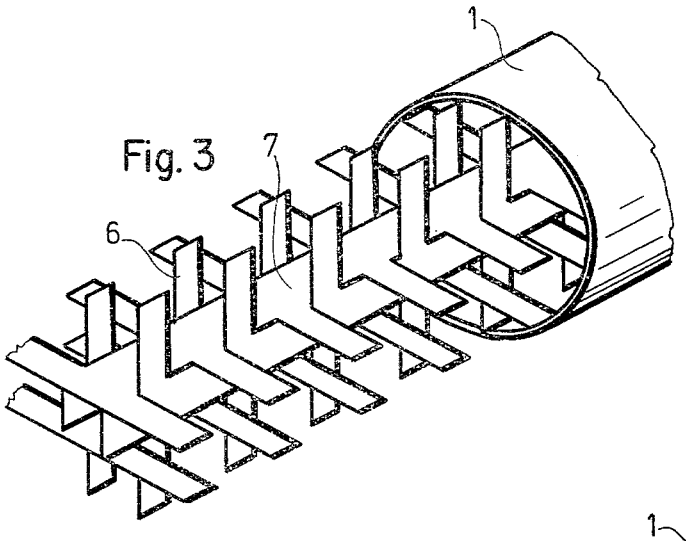
FIG. 3 is a perspective view of the ribbed construction in accordance with the invention consisting of four metal bands.

The simplest shape of the so-produced metal band 2 is shown in FIG. 1. Three or four of the toothed metal bands 2 are fitted together according to FIGS. 2 and 3, so as to have the teeth 6 interdigitate with each other. In this way a construction is obtained which has a channel 3 extending along the center, and the teeth 6 protruding from the corners of the formed channel 3 alternately in two directions (see FIGS. 4 and 5). This construction is pushed into the pipes 1 of the heat exchanger. Width of the band and depth of the teeth 6 are selected to have the ribs formed from metal bands 2 and fitted into each other to be easily movable in pipe 1, so that pipe 1 shall not cause a disruption of the lattice work of the metal bands 2.

Since the ribs are loose, they can be shifted by the medium flowing in pipe 1, consequently suitable buffers were placed into both ends of pipe 1.

Figure 4:
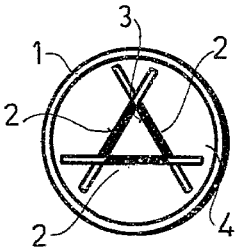
FIG. 4 is a cross sectional view of the embodiment of the invention shown in FIG. 2.
Figure 5:
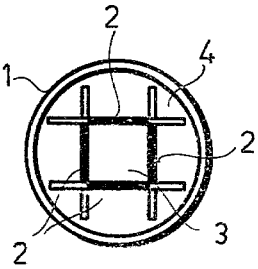
FIG. 5 is a cross sectional view of the embodiment of the invention shown in FIG. 3.

The cross section of the pipe 1 provided with metal ribs when the ribs consist of three and four bands is shown in FIGS. 4 and 5, respectively. The cross section illustrates well the annular space 4 between pipe 1 and channel 3, divided into sections by the toothing of the ribs. The so-developed ribs apply a powerful braking effect to the flow velocity, thereby preventing the escape of large amounts of medium in the center of pipe 1, which amounts of medium would not or minimally participate in the heat exchange; on the other hand, the medium flowing in the small-sized channel is in contact with relatively large rib surfaces and therefore the heat exchange is readily taking place.

Figure 6A:
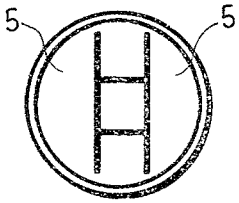
FIGS. 6*a* and 6*b* are further sectional views of the embodiment of the invention shown in FIG. 3, illustrating two half ribs and teeth spaced from each other.
Figure 6B:
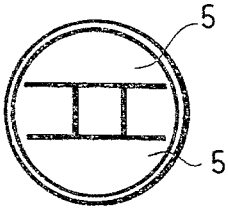

The flow in space 4 between pipe 1 and channel 3 is slowed down only by the teeth of the ribs, and therefore here the velocity is higher than in channel 3. In this space the heat transfer between the ribs and the medium is effective, since the toothing 6 of the ribs 6 is narrow, thus no thick limiting layer can develop, and the effective heat conduction of the metal ribs ensures a radial heat flow. In addition to the heat conduction of the ribs, it exerts a mixing effect, because its teeth confine the space 4 in such a way, that the hydraulic radius of each space-section varies intermittently along the tooth pitch. This variation of the cross section—in case of inner ribs assembled from four metal bands 2 according to FIG. 3—is illustrated in FIGS. 6*a* and 6*b*, by a cross section showing the half rib spacing between two ribs. It is apparent that the cross section 5 of lower resistance is on both sides in FIG. 6*a* and at the top and bottom in FIG. 6*b*. This change of resistance forces the flowing medium to constantly change direction, and thereby a mixing effect is brought about in space 4, which improves the heat transfer.

The mixing effect is further improved, if the toothing 6 is arranged at an angle as is shown in the embodiment of FIG. 7. This solution facilitates the removal and insertion of the ribs.

In order to increase the mixing effect, the metal bands 2 with the teeth projecting at an angle are fitted together in such a way, that the toothing 6 points into the flow direction at one of the pairs of bands 7, and in the opposite direction in the other pair of bands 7 (see FIG. 8).

In case of perpendicular and sloping tooth formations it is advisable to widen the end of the toothing 6 in accordance with the embodiments of FIGS. 9 and 10, whereby the rib surface near the pipe wall is increased.

Figure 12A:
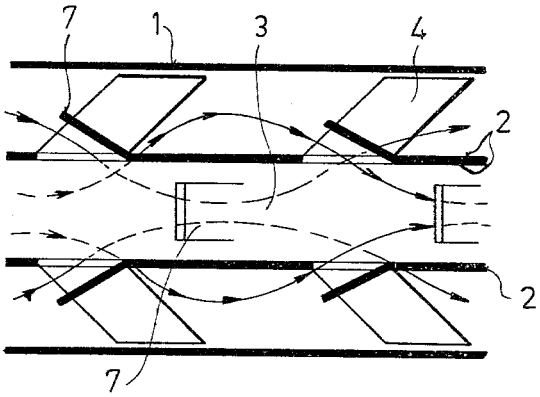
FIG. 12*a* is a longitudinal sectional view of the ribbed construction in accordance with this invention as assembled from sheet metal bands provided with baffle plates arranged in a pipe.
Figure 12B:
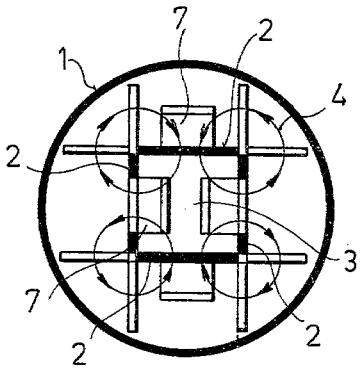
FIG. 12*b* is a cross sectional view of the embodiment of FIG. 12*a;*

With the hereinafter described rib formations it is possible to utilize the rib-surrounded channel 3 for the mixing, or use it to increase the intensity of mixing. This is attained by "U"-shaped cutouts in the central part of the metal band 2, and by bending them out at an angle (see FIGS. 11*a* and 11*b*). In this way baffle plates 8 are obtained, which deflect the liquid flowing along the longitudinal axis of the rib through the opening, exposed by the bending, from one side to the other one of the rib. If the so-developed ribs are fitted to each other in such a manner that the baffle plates 8 extend alternately outward at one band and inward at the other band, then the flow pattern along the rib in accordance with FIGS. 12*a* and 12*b* will develop in such a way that outward bent baffle plates deflect the liquid from the outside toward the interior of the central channel 3, while the inward bent baffle plates will deflect the liquid flowing in channel 3 outward towards the space 4 between the channel and the pipe.

Since on one metal band 2 there occurs only outflow and on the other one only inflow, with respect to the central channel 3, in the interest of continuity the liquid is forced to flow in the space 4 between the channel and the pipe not only in a straight line, but in lateral direction as well. In this way the liquid in the pipe, when four ribs are used, flows according to FIG. 12 in four spiral streamlines; thus the liquid flowing in the center or near the pipe wall will continuously be changed over, and be mixed with other liquid thereby considerably improving the heat transfer.

The rib formation with baffle plate in accordance with the invention will be applicable in combination with any of the afore-described rib formations.

Figure 13A:
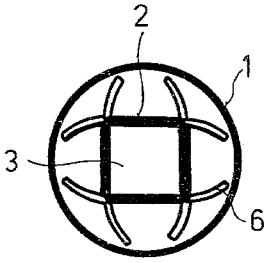
FIGS. 13*a* and 13*b* are cross-sectional views of ribbed plate constructions with curved teeth in accordance with the invention wherein the teeth are shaped to conform to the inner pipe jacket.
Figure 13B:
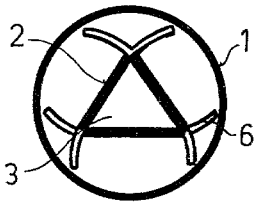

The rib formation developed from the aforedescribed toothed metal bands 2 ensures effective heat transfer even in case when it fits loosely in the pipe. This however does not mean that the invention is intended to give up the advantage of the tooth ends 6 being tightly fitted to the pipe wall 1, in particular when it is intended to cool such liquid which does not pollute the heat exchanger, and consequently a subsequent cleaning is not required. The ribs assembled from the metal bands 2 have the advantage whereby this method is suitable for the production of such ribs where the tooth ends are in uniform and tight contact with the inner part of pipe 1. This type of ribs is shown in FIGS. 13*a* and 13*b*, in the embodiment assembled from three to four toothed metal bands 2, respectively.

Its main feature is that the metal band 2 toothed on both sides and made of thin sheet metal is easily and flexibly deformed in cross direction, i.e. it is substantially more flexible when curved, than in its flat shape.

In view of the fact that toothing 6 of the ribs is arranged excentrically, i.e. chordwise instead of radially or diagonally in the pipe cross section, the deformations of the teeth 6 can occur not only in its own plane, but also in a plane perpendicularly to it, so as to avoid its jamming in pipe 1 when being inserted therein. Since the rib is highly flexible in cross direction, it readily adapts itself to the inner irregularities of the pipe, and no excessive pulling force is necessary to obtain uniform and suitable contact between the pulled-in rib and the walls of the pipe 1.

Although the invention is illustrated and described with reference to a plurality of embodiments thereof, it is to be expressly understood that it is in no way limited to the disclosure of such preferred embodiments, but is capable of numerous modifications within the scope of the appended claims.

We claim:

1. In a heat exchanger pipe, a ribbed construction for heat transfer mounted in said heat exchanger pipe comprising at least three metal bands adjoining one another and each having a plurality of projecting teeth defining indentations therebetween, the projecting teeth of one adjoining metal band extending into said indentations of another adjoining metal band, said metal bands defining a longitudinal central channel in said pipe extending the length of the bands.

2. The ribbed construction as set forth in claim 1, wherein said longitudinal channel is, in transverse cross-section of the pipe, in the shape of a regular polygon, the number of sides of which correspond to the number of metal bands used for the ribbed construction.

3. The ribbed construction as set forth in claim 2, wherein three metal bands are used for the ribbed construction.

4. The ribbed construction as set forth in claim 2, wherein four metal bands are used for the ribbed construction.

5. The ribbed construction as set forth in claim 1, wherein said plurality of teeth project perpendicularly relative to the longitudinal axis of said pipe from said metal band.

6. The ribbed construction as set forth in claim 1, wherein said plurality of teeth project at an angle relative to the longitudinal axis of said pipe from said metal band.

7. The ribbed construction as set forth in claim 6, wherein the teeth of said metal bands interdigitate in such a a way that the angularity of the teeth of adjacent metal band is mutually opposite.

8. The ribbed construction as set forth in claim 1, wherein the projecting teeth are widest at their free ends.

9. The ribbed construction as set forth in claim 1, wherein said metal bands are composed of a main longitudinal body from which said projecting teeth of said metal bands extend laterally, and portions of said main longitudinal body being bent away from it to form baffle plates and expose openings therein.

10. The ribbed construction as set forth in claim 9, wherein the metal bands are arranged relative to each other so that the baffle plates of at least one metal band extend substantially toward the longitudinal axis of said pipe and the baffle plates of at least one other metal band extend substantially away from said longitudinal axis.

11. The ribbed construction as set forth in claim 1, wherein the free ends of said projecting teeth are in contact with the walls of the pipe.

* * * * *